US011300020B2

(12) United States Patent
Li et al.

(10) Patent No.: US 11,300,020 B2
(45) Date of Patent: Apr. 12, 2022

(54) QUANTITATIVE ONE-WAY OIL GAS LUBRICANT SYSTEM AND METHOD FOR 4-STROKE ENGINE

(71) Applicant: ZHEJIANG YAT ELECTRICAL APPLIANCE CO., LTD, Zhejiang (CN)

(72) Inventors: Zhijun Li, Zhejiang (CN); Jian Yu, Zhejiang (CN)

(73) Assignee: ZHEJIANG YAT ELECTRICAL APPLIANCE CO., LTD, Zhejiang (CN)

( * ) Notice: Subject to any disclaimer, the term of this patent is extended or adjusted under 35 U.S.C. 154(b) by 194 days.

(21) Appl. No.: 15/884,385

(22) Filed: Jan. 31, 2018

(65) Prior Publication Data

US 2018/0156085 A1 Jun. 7, 2018

Related U.S. Application Data

(63) Continuation of application No. PCT/CN2016/079099, filed on Apr. 12, 2016.

(30) Foreign Application Priority Data

Mar. 18, 2016 (CN) ..... 201610156567.7

(51) Int. Cl.
*F01M 11/06* (2006.01)
*F01M 11/00* (2006.01)
(Continued)

(52) U.S. Cl.
CPC ..... *F01M 11/062* (2013.01); *F01M 1/04* (2013.01); *F01M 1/12* (2013.01);
(Continued)

(58) Field of Classification Search
CPC .. F01M 11/062; F01M 11/06; F01M 11/0004; F01M 1/04; F01M 1/12;
(Continued)

(56) References Cited

U.S. PATENT DOCUMENTS 5,709,185 A * 1/1998 Aizawa ..... F01M 1/04 123/196 CP
6,877,494 B2 * 4/2005 White ..... F01M 1/04 123/572
(Continued)

FOREIGN PATENT DOCUMENTS

CN 200978692 11/2007
CN 201635790 11/2010
(Continued)

*Primary Examiner* — Grant Moubry
(74) *Attorney, Agent, or Firm* — JCIPRNET

(57) ABSTRACT

A quantitative one-way oil gas lubricant system and a method for a 4-stroke engine, including a preceding stage quantitative oil intake orifice that is connected to a lubricant case on a wall of a crankcase of the 4-stroke engine, and a final stage quantitative airflow orifice disposed at a cylinder cover of the 4-stroke engine, are provided. A diameter of the preceding stage quantitative oil intake orifice $D_1$ and a diameter of the final stage quantitative airflow orifice satisfy an equation: $D_1/D_3$=0.8-1.5, wherein a one-way connected oil gas lubricant channel is disposed between the preceding stage quantitative oil intake orifice and the final stage quantitative airflow orifice. A lubricant oil sucked from the preceding quantitative oil intake orifice by the crankcase flows along the oil gas lubricant channel and lubricates the engine parts that the channel passes through in turns. Finally, a minute quantity of waste oil gas that flows out from the final stage quantitative airflow orifice is introduced into a cylinder of the 4-stroke engine and is to be burned completely. The supply quantity of the lubricant oil may be controlled, and no extra lubricant oil gas may flow out from
(Continued)

the final stage quantitative airflow orifice, therefore, the quantitative and one-way lubricating is realized.

15 Claims, 4 Drawing Sheets

(51) Int. Cl.

| | |
|---|---|
| ***F01M 1/04*** | (2006.01) |
| ***F01M 1/12*** | (2006.01) |
| ***F02F 1/42*** | (2006.01) |
| ***F02F 7/00*** | (2006.01) |
| ***F02B 63/04*** | (2006.01) |

(52) U.S. Cl.
CPC ..... *F01M 11/0004* (2013.01); *F01M 11/06* (2013.01); *F02B 63/04* (2013.01); *F02F 1/4214* (2013.01); *F02F 7/0065* (2013.01); *F02F 2007/0075* (2013.01)

(58) Field of Classification Search
CPC ..... F02F 1/4214; F02F 1/24; F02F 7/0065; F02F 2007/0075; F02B 63/04
See application file for complete search history.

(56) References Cited

U.S. PATENT DOCUMENTS

| | | | | |
|---|---|---|---|---|
| 2007/0245983 | A1* | 10/2007 | Igarashi | F01M 13/04 123/41.1 |
| 2012/0132185 | A1* | 5/2012 | Kurihara | F01M 1/02 123/590 |
| 2015/0000633 | A1* | 1/2015 | Kurihara | F01M 1/02 123/319 |
| 2015/0136065 | A1* | 5/2015 | Kong | F01M 9/10 123/196 CP |

FOREIGN PATENT DOCUMENTS

| | | | | |
|---|---|---|---|---|
| CN | 102428255 | | 4/2012 | |
| CN | 103993927 | | 8/2014 | |
| CN | 204082332 | | 1/2015 | |
| CN | 104389691 | | 3/2015 | |
| CN | 104727897 | | 6/2015 | |
| CN | 104791048 | | 7/2015 | |
| CN | 204783314 | | 11/2015 | |
| CN | 205503221 | | 8/2016 | |
| EP | 1486652 | A1 * | 12/2004 | F01M 11/065 |
| GB | 2374386 | | 10/2002 | |
| JP | H09250324 | | 9/1997 | |
| JP | H10246106 | | 9/1998 | |
| JP | 2000303814 | | 10/2000 | |
| JP | 2015007384 | | 1/2015 | |
| WO | WO-2008150222 | A1 * | 12/2008 | F01M 11/02 |
| WO | WO-2015165294 | A1 * | 11/2015 | F01M 1/04 |

* cited by examiner

QUANTITATIVE ONE-WAY OIL GAS LUBRICANT SYSTEM AND METHOD FOR 4-STROKE ENGINE

CROSS-REFERENCE TO RELATED APPLICATION

This is a continuation of International Application No. PCT/CN2016/079099, filed on Apr. 12, 2016, which claims the priority benefits of China Application No. 201610156567.7, filed on Mar. 18, 2016. The entirety of each of the above-mentioned patent applications is hereby incorporated by reference herein and made a part of this specification.

TECHNICAL FIELD

The present invention relates to a lubricant system and method for an engine.

BACKGROUND

Many patents relating to the lubricant system for an engine have been found in the foreign countries and domestic by far. Besides the essential engine parts structure of the 4-strokes engine, the information shows that the contents of these inventions mainly relate to the ideas of the lubricant system, which are designed for preventing the tubes from spraying oil and for ensuring sufficient lubrication during the overturn operation. Check valves, rotary valves, mixture needles, oil feeder channels, return oil channels, oil feeder pipes, oil return pipes etc. are designed for the former purpose, and all these designs follow the design ideas of "circulation lubricant system".

Even though these designs are so complex, the former defects are still found in the tests to various types of foreign and domestic engines, that is, the lubricating oil will still spray from the tubes at a certain station during the overturning operation of the engine. Additionally, tubes from all types of engines are all connected into the air filters, therefore, even at normal stations, after the engines run for a period, the outgoing lubricating oil may immerse the filter cotton of the air filter, or even flow out of the housing. This proves that the design theory and the mechanical structure of "circulation lubricant system" should be improved.

Therefore, in the lubricant system of the 4-strokes engine, how to satisfy the normal operation during freely overturning operation, reduce the lubricating consumption rate, and prevent the filter cotton from being immersed by the lubricating oil when the tubes are connected into the air filters, and find a solution having reliable performance, simple structures and reduced cost is a significant problem in the field.

SUMMARY OF THE INVENTION

The technical problem to be solved is to provide a quantitative one-way oil gas lubricant system and method for a 4-stroke engine, to reduce the consumption rate of lubricant, and to prevent the filter cotton from being immersed by the lubricating oil when the tubes are connected into the air filters.

In order to solve the above technical problems, the technical solution of the present invention is: a quantitative one-way oil gas lubricant system for a 4-stroke engine, which comprises a preceding stage quantitative oil intake orifice that is connected to a lubricant case on a wall of a crankcase of the 4-stroke engine, and a final stage quantitative airflow orifice disposed at a cylinder cover. A diameter of the preceding stage quantitative oil intake orifice $D_1$ and a diameter of the final stage quantitative airflow orifice satisfy an equation: $D_1/D_3$=0.8-1.5. A one-way connected oil gas lubricant channel is disposed between the preceding stage quantitative oil intake orifice and the final stage quantitative airflow orifice.

Preferably, the diameter $D_1$ of said preceding stage quantitative oil intake orifice and the diameter $D_3$ of said final stage quantitative airflow orifice satisfy an equation: $D_1/D_3$=1-1.2.

Preferably, a relation between the diameter $D_1$ of said preceding stage quantitative oil intake orifice, a volume of the lubricant case and an engine displacement satisfies the following equation: $D_1$=K (the volume of the lubricant− the engine displacement), in which, the unit of $D_1$ is mm, the unit of the volume of the lubricant case and the engine displacement is $cm^3$, and a value range of K is 0.011-0.02.

Preferably, a distance between each side of an inner wall of the crankcase and a corresponding side of a rotating space of a crank is smaller than 2 mm.

Preferably, a bulge part bulged to a center position of the crank along an axial direction, is disposed on the two inner sides of the crankcase, which are corresponding to two sides of the crank along the axial direction.

Preferably, an inter-stage quantitative oil orifice is disposed between the crankcase and a cam box of the 4-stroke engine, and a diameter of the inter-stage quantitative oil orifice $D_2$ is less than or equal to $3D_1$.

Preferably, the lubricant case has a U-shaped section that is perpendicular to the crankshaft. The crankcase is surrounded by the lubricant case, and the left and right sides of the crankcase are each disposed with a preceding quantitative oil intake orifice. When the 4-stroke engine is under a condition of being disposed horizontally, the two preceding stage quantitative oil intake orifices are positioned at a cross point of two center lines, one of which is a forward-backward volume center line of the lubricant case, and the other of which is a forward-backward center line of the left and right side walls of the crankcase.

Preferably, when the engine is under the condition of being disposed horizontally, the preceding quantitative oil intake orifice is positioned on a cross line of the volume center surface of the lubricant oil case and a case wall of the crankcase.

Preferably, oil-shielding ribs are disposed on an outer case wall of the crankcase, at two sides of the preceding quantitative oil intake orifice or surrounding the preceding quantitative oil intake orifice.

Preferably, the final stage quantitative airflow orifice is connected with a cylinder of the 4-stroke engine through a connection pipe.

The present invention also provides a quantitative one-way oil gas lubricating method for the 4-stroke engine, by controlling the diameter of the preceding quantitative oil intake orifice $D_1$ and the diameter of the final stage quantitative airflow orifice $D_3$ to satisfy the relation: $D_1/D_3$=0.8-1.5, so that a pressure of an output end of the final stage quantitative airflow orifice will always smaller than a pressure in the crankcase. The lubricant oil sucked by the crankcase from the preceding quantitative oil intake orifice flows along the oil gas lubricant channel and lubricates the engine parts that the channel passes through in turns. Finally, a minute quantity of waste oil gas that flows out from the final stage quantitative airflow orifice is introduced into the cylinder and is to be burned completely.

Furthermore, the oil gas lubricant channel, from the preceding quantitative oil intake orifice to the final stage quantitative airflow orifice, connects the crankcase, the cam box, the push rod channel and the upper rocker box in turns.

Furthermore, by controlling the diameter of the preceding quantitative oil intake orifice $D_1$ and the volume of the lubricant oil case and the power capacity of the 4-stroke engine to satisfy an equation: $D_1$=K (the volume of the lubricant oil case− the power capacity of the engine), a blow-and-suck pressure that a pulse air current applies to the lubricant oil in the lubricant oil case is controlled so as to control a flow quality of the lubricant oil that flows from the lubricant oil case to the crankcase in a range of 1.5-2 g/kw·h, wherein the unit of $D_1$ is mm, the unit of the lubricant oil case and the power capacity of the 4-stroke engine is $cm^3$, and K may take the value from a range of 0.011-0.02.

Furthermore, the diameter of the inter-stage quantitative oil orifice $D_2$ is controlled to be less than or equal to $3D_1$ so as to make sure that a pressure of the crankcase during operation is in a range of minus 0.003-0.008 Mpa.

In addition, the present invention further provides:

a gasoline saw, which is disposed with the abovementioned quantitative one-way oil gas lubricant system;

a pruning shear, which is disposed with the abovementioned quantitative one-way oil gas lubricant system;

a grass trimmer, which is disposed with the abovementioned quantitative one-way oil gas lubricant system;

a brush cutter, which is disposed with the abovementioned quantitative one-way oil gas lubricant system;

an electric blower, which is disposed with the abovementioned quantitative one-way oil gas lubricant system;

a lawn mower, which is disposed with the abovementioned quantitative one-way oil gas lubricant system;

an electric generator, which is disposed with the abovementioned quantitative one-way oil gas lubricant system;

a water pump, which is disposed with the abovementioned quantitative one-way oil gas lubricant system;

a high pressure washer, which is disposed with the abovementioned quantitative one-way oil gas lubricant system; and a universal small engine, which is disposed with the abovementioned quantitative one-way oil gas lubricant system.

The technical solution of the present invention, by controlling the diameter of the preceding stage quantitative oil orifice $D_1$ and the diameter of the final stage quantitative airflow orifice $D_3$, ensures that the pressure of the output end of the final stage quantitative gas orifice always be smaller than the pressure in the crankcase and ensures that the negative pressure be kept in a certain range. Since the diameter of the preceding quantitative oil intake orifice $D_1$ is used to control the pulse air current pressure and the oil droplet quantity, and the diameter of the final stage quantitative airflow orifice $D_3$ is designed to make sure that the lubricant oil in the machine flows out as little as possible, the diameter of the preceding quantitative oil intake orifice $D_1$ and the diameter of the final stage quantitative airflow orifice $D_3$ may cooperate to control the supply quantity of the lubricant oil accurately, and no extra lubricant oil gas may flow out from the final stage quantitative airflow orifice, therefore, the quantitative and one-way lubricating is realized.

Furthermore, since the lubricant oil channel between the preceding stage quantitative oil intake orifice and the final stage quantitative airflow orifice has a one-way connection structure, and the cavities to be lubricated in each stage are connected with a single oil gas quantitative orifice, so no extras lubricant oil will flow out from the final stage quantitative airflow orifice and back to the lubricant oil case, and oil return channel, check valve or oil collector exists in the whole lubricant oil system. And the system is without any mechanism that is used to stir the lubricant oil to produce smog. For the above reasons, the principle of the lubricant system in the present invention is different from the lubricant systems in the prior art.

Furthermore, the quantitative oil gas lubricates the next parts in turns; finally, a minute quantity of waste oil gas being remained is introduced to the cylinder directly and will be burned completely to reduce the consumption of the lubricant oil and the pollution, thus prevents the filter cotton from being immersed by the lubricating oil when the tubes are connected into the air filters, so as to reduce the pollution of the machine and the environment. The lubricant system of the present invention has a stable function, a simple structure and a low price.

Additionally, the crankcase is designed to ensure that the distance between the inner wall sides and the corresponding surface of the rotate space less than or equal to 2 mm. Therefore, no extra lubricant oil may remain in the crankcase, and the engine may be overturned in any certain angle.

BRIEF DESCRIPTION OF THE DRAWINGS

Further description of the present invention may be described below combining with the figures and the specific embodiments.

DESCRIPTION OF THE PREFERRED EMBODIMENTS

Figure 1:
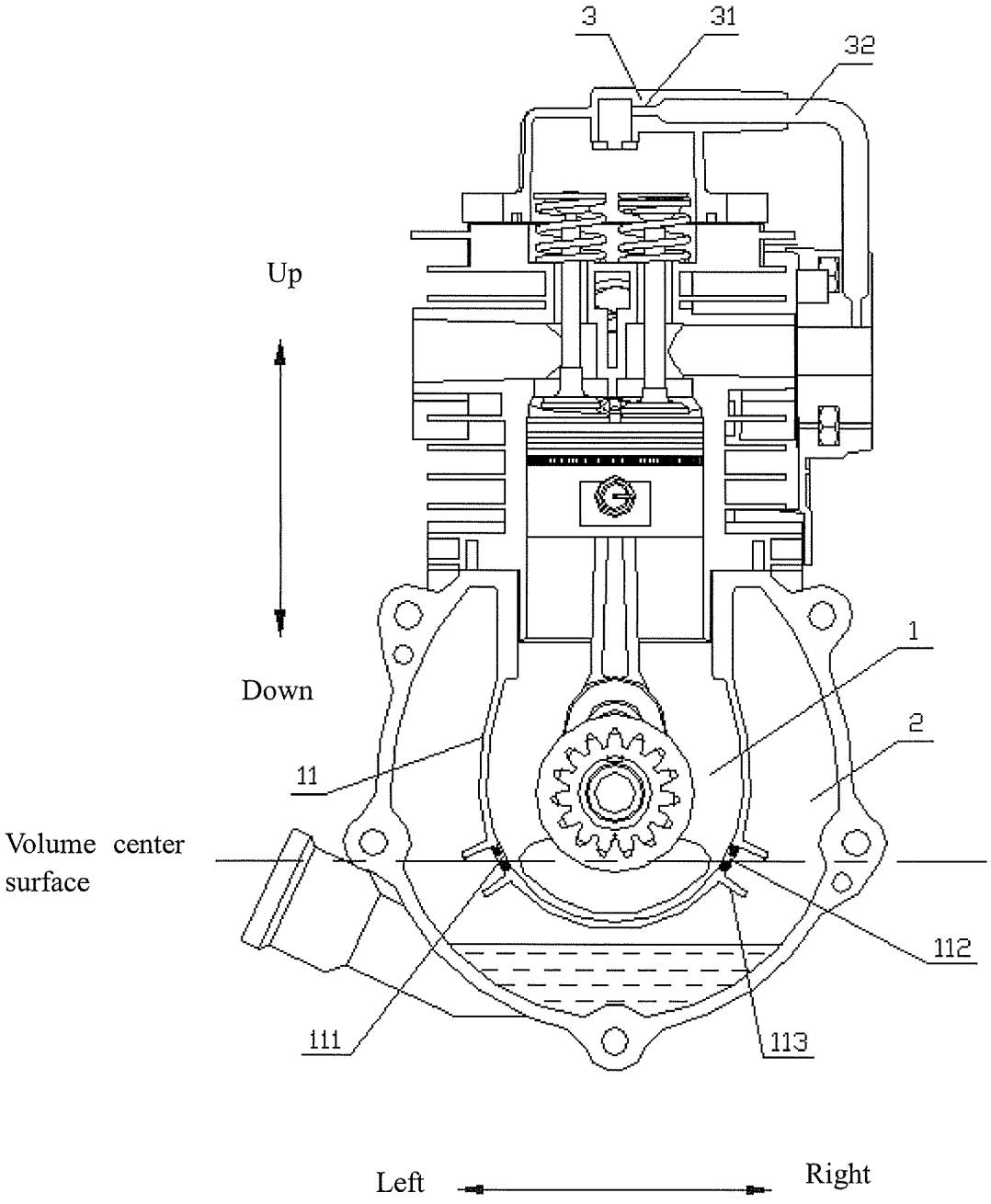
FIG. 1 shows the schematic diagram of the engine under a condition of being disposed horizontally.

As shown in the FIGS. 1-6, the 4-stroke engine in the state of the art is disposed with a crankcase 1, a lubricant case 2, a cam box 4, a push rod 5, an upper rocker box 6 and a cylinder, top of which is disposed with a cover 3.

As shown in the FIG. 1, when the engine is under a condition of being disposed horizontally, seen from directly in the front side, the lubricant case 2 has a U-shaped section that is perpendicular to the crankshaft. The crankcase 1 is surrounded by a lubricant case 2, and a U-shaped cavity of the lubricant case 2 is formed between the wall of the crankcase 11 and the wall of the lubricant case 2, the bottoms of the crankcase 1 and the lubricant case 2 are both circular arcs which bulge downward, and the right and left sides of the crankcase 1 and the lubricant case 2 are both shown as circular arcs which bulge outward.

According to the present invention, the pulsing oil gas lubricant system for a 4-stroke engine comprises preceding stage quantitative oil intake orifices on left and right walls of the crankcase 1, that is, the first preceding stage quantitative oil intake orifice 111 located at the left side wall of the crankcase 1 and the second preceding stage quantitative oil intake orifice 112 located at the right side wall of the crankcase. When the engine is under the condition of being disposed horizontally, the two preceding stage quantitative oil intake orifices are positioned near the cross point of two center lines, one of which is forward-backward volume center line of the lubricant case, and the other of which is the forward-backward center line of the left and right side walls of the crankcase 1, and offset is allowed for the position of the orifices, for example, the distance with the cross point may be selected from the range of 0-20 mm. When the engine is under the condition of being disposed horizontally, the two preceding stage quantitative oil intake orifices are located at the positions that are no more than 50 mm above the liquid level of the lubricant oil. Even if the shape of the lubricant case 2 changes, when the engine is under the condition of being disposed horizontally, for the preceding stage quantitative oil intake orifices, the preferred design is to dispose it on the intersecting lines of the volume center surface of the lubricant case and the wall of the crankcase, and the more specific position on the line may be decided according to the shape of the lubricant case.

The lubricant case 2 and the crankcase 1 are connected through the preceding stage quantitative oil intake orifices, and the cam box 4 is connected with the upper rocker box 6 with the push rod channel, and the cylinder cover 3 is disposed with a final stage quantitative airflow orifice 31 thereon, and the final stage quantitative airflow orifice 31 is connected with the upper rocker box 6. Thereby, a one-way connected oil gas lubricant channel is formed between the preceding stage quantitative oil intake orifice and the final stage quantitative airflow orifice 31.

The pulsing oil gas lubricant system for a 4-stroke engine of the present invention blows and sucks the lubricant oil in the lubricant case 2 with the pulse airflow produced by the up-and-down movement of the piston. The diameter of the preceding stage quantitative oil intake orifice $D_1$ and the diameter of the final stage quantitative airflow orifice $D_3$ are controlled to satisfy the equation: $D_1/D_3$=0.8-1.5, more preferably, to satisfy the equation: $D_1/D_3$=1-1.2. The blow-and-suck pressure that the pulse gas applies to the lubricant oil in the lubricant case 2 may be controlled by changing the diameter of the preceding stage quantitative oil intake orifice $D_1$, thereby the flow rate of the lubricant oil that flows from the lubricant case 2 to the crankcase 1 is controlled correspondingly. The diameter of the final stage quantitative airflow orifice $D_3$ is designed to make sure that the lubricant in the machine flows out as little as possible, while the power capacity is not affected. Thereby, due to the single one-way connected oil gas lubricant channel between the preceding stage quantitative oil intake orifice and the final stage quantitative airflow orifice, the output end pressure of the final stage quantitative airflow orifice 31 may be accurately controlled in the range of 0.01-0.03 Mpa through the cooperative control to the preceding stage quantitative oil intake orifice $D_1$ and the diameter of the final stage quantitative airflow orifice $D_3$, and as a result, the lubricant oil gas supply may be controlled accurately. In this way, the parts at where the oil gas lubricant channel goes through are lubricated sufficiently, and no extra lubricant oil will flow out from the final stage quantitative airflow orifice 31, additionally, during the process that the lubricant oil gas goes from the preceding stage quantitative oil intake orifice on the crankcase wall to the final stage quantitative airflow orifice 31 on the cylinder cover, lubricated component stages are connected by a single gas oil orifice, thus forms a one-way connected oil gas lubricant channel, this ensures that no extra lubricant oil may flow back into the lubricant case 2 from the crankcase 1 or other cavities, realizing the one-way quantitative lubricating.

Figure 5:
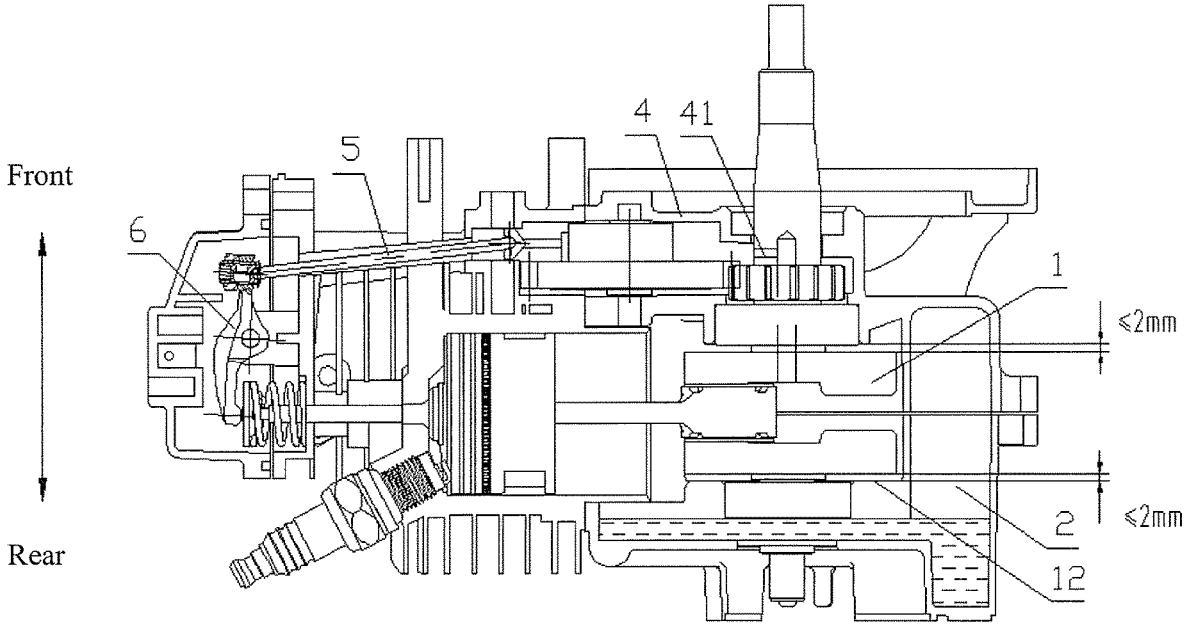
FIG. 5 shows the schematic diagram of the engine under a rear-mounted condition.
Figure 6:
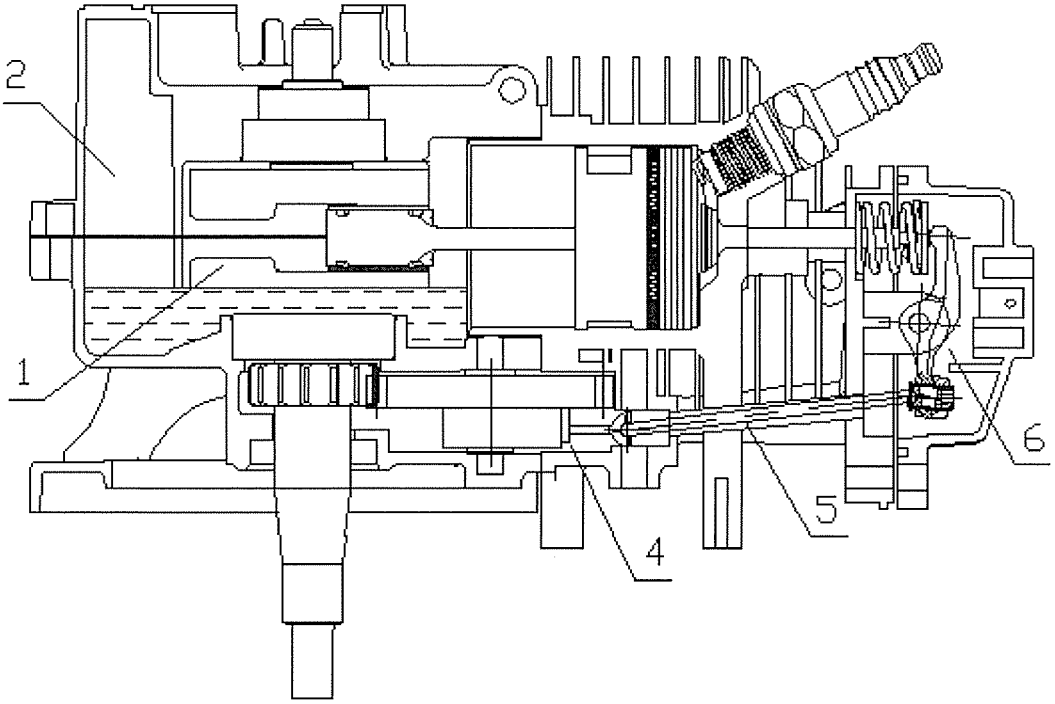
FIG. 6 shows the schematic diagram of the engine under a front-mounted condition.

Furthermore, as shown in the FIG. 5, inter-stage quantitative oil orifice 41, and the diameter of the inter-stage quantitative oil orifice $D_2$ is less than or equal to $3D_1$. The inter-stage quantitative oil orifice 41 introduces the concept of hierarchical control. When the preceding stage quantitative oil intake orifice $D_1$ and the final stage quantitative airflow orifice $D_3$ are determined, the traveling speed and the delivery capacity of the lubricant oil from the preceding stage quantitative oil intake orifice to the final stage quantitative airflow orifice may be controlled by controlling the diameter of the inter-stage quantitative oil orifice $D_2$, thus realizing accurate control.

Figure 2:
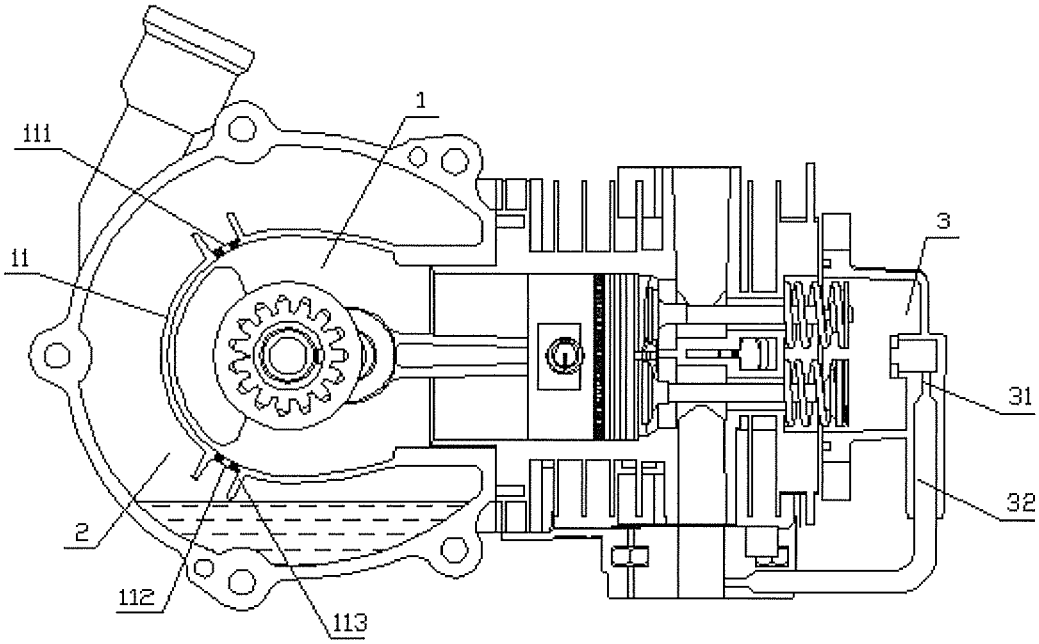
FIG. 2 shows the schematic diagram of the engine under a right-mounted condition.
Figure 3:
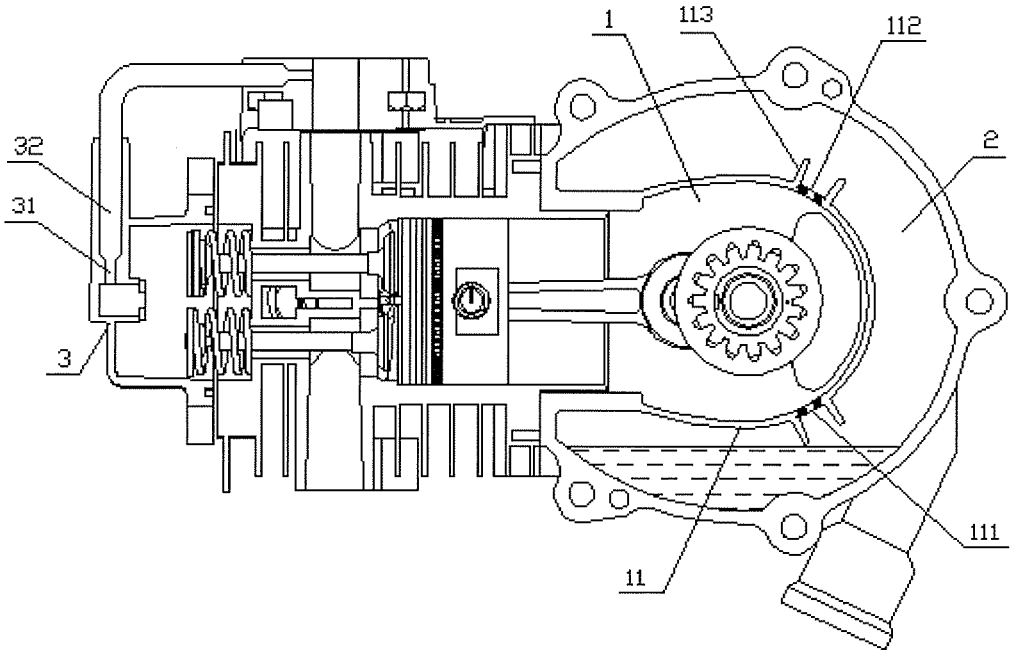
FIG. 3 shows the schematic diagram of the engine under a left-mounted condition.
Figure 4:
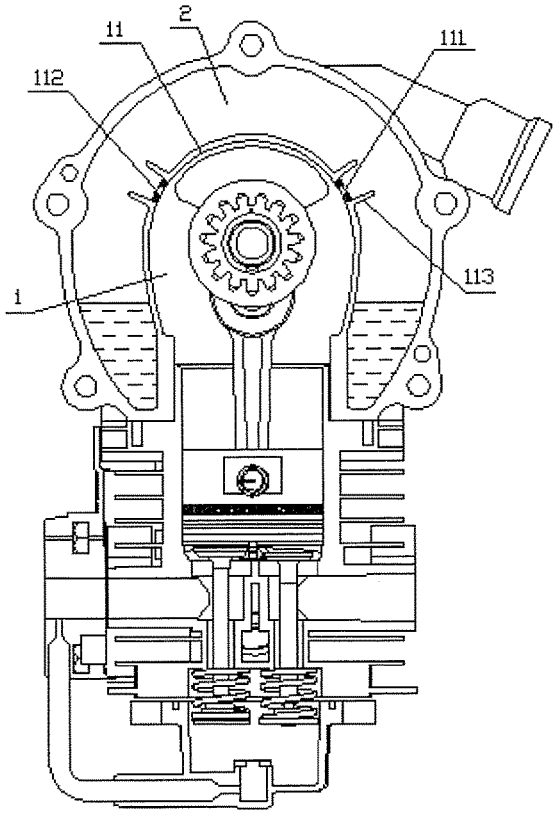
FIG. 4 shows the schematic diagram of the engine under an inverted condition.

The design of two preceding stage quantitative oil intake orifices is used to make sure that the preceding stage quantitative oil intake orifice may work no matter how the engine is overturned so as to satisfy the normal operation of the quantitative one-way oil gas lubricant system of a 4-stroke engine. As shown in FIG. 1, when the engine is under the condition of being disposed horizontally, both of the first preceding stage quantitative oil intake orifice 111 and the second preceding stage quantitative oil intake orifice 112 work. As shown in FIG. 2, when the engine is under a right-mounted condition, the second preceding stage quantitative oil intake orifice 112 works mainly. As shown in FIG. 3, when the engine is under the left-mounted condition, the first preceding stage quantitative oil intake orifice 111 works mainly. And as shown in the FIGS. 4-6, when the engine is under an inverted condition, or a rear-mounted condition, or a front-mounted condition, both of the first preceding stage quantitative oil intake orifice 111 and the second preceding stage quantitative oil intake orifice 112 work.

As shown in the FIG. 1, oil-shielding ribs 113 are disposed on the left and right sides of the outer case wall of the crankcase 1 at the upper and lower sides of the preceding stage quantitative oil intake orifice. The preceding stage quantitative oil intake orifice is disposed between oil-shielding ribs 113 at the upper and lower sides. Due to the blocking function of the oil-shielding ribs 113, when the engine is overturned with a certain angle, even the lubricant oil on the case wall that is closely against the preceding stage quantitative oil intake orifice will not flow into the crankcase 1 through the preceding stage quantitative oil intake orifice. Alternatively, the oil-shielding ribs may be disposed around the circumference of the preceding stage quantitative oil intake orifice to get better oil-blocking effect.

Since the volume of the lubricant oil case and the power capacity of the engine may change, therefore, the diameter of the preceding stage quantitative oil intake orifice $D_1$ and the volume of the lubricant oil case and the power capacity of the 4-stroke engine satisfy the following equation: $D_1$=K (the volume of the lubricant oil case− the power capacity of the engine), wherein the unit of $D_1$ is mm, and the unit of the lubricant oil case and the power capacity of the 4-stroke engine is cm3, and K may take the value from the range of 0.011-0.02, and the value of K depends on the capacity, generally, K may be larger when the power capacity is large, and K may be smaller when the power capacity is small.

Finally, the final stage quantitative airflow orifice 31 is connected to the cylinder through the communicating pipe 32, thus, even some part of lubricant oil flows out from the final stage quantitative airflow orifice 31, the remaining little waste oil gas may be introduced to the cylinder through the communicating pipe 32 so as to burn the remaining little waste oil gas fully to reduce the consumption of the lubricant oil and to reduce waste emissions. Finally, the requirement of quantitative one-way oil gas lubricating is achieved, no extra lubricant oil that has been lubricated parts will flow back to the lubricant oil case 2 from the crankcase 1 or other cavities.

In addition, in order to ensure the normal operation when the engine is overturned in any angles, another essential condition is required, that is, the crankcase 1 should be designed to make sure that the distance between each side of the inner wall of the crankcase and the corresponding side of the rotating space of the crank is smaller than 2 mm. As shown in FIG. 5, the crankcase 1 is disposed with a bulge part 12, to make sure that the distance between each side of the inner wall of crankcase and the corresponding side of the rotating space of the crank is smaller than 2 mm, so as to make sure that no extra space in the crankcase 1 keeps lubricant oil from the lubricant oil case 2 in it when the engine is overturned with a certain angle, and except the quantitative lubricant oil flow through the parts that are to be lubricated in the crankcase 1, the remaining lubricant oil can only flow through the inter-stage quantitative oil orifice and continue flowing in a single direction to lubricate the cam box 4.

The above-mentioned pulse oil gas lubricant system of the 4-stroke engine controls the supply quantity of the lubricant oil gas and the flow velocity of the lubricant oil that flows in the oil gas lubricant channel accurately by controlling the diameter of the preceding stage quantitative oil intake orifice $D_1$ and the diameter of the final stage quantitative airflow orifice $D_3$ to satisfy the equation: $D_1/D_3$=0.8-1.5 and controlling the diameter of the preceding stage quantitative oil intake orifice $D_1$, the volume of the lubricant case and the engine displacement to satisfy the equation: $D_1$=K (the volume of the lubricant− the engine displacement). Therefore, the supply quantity of the lubricant oil gas and the flow velocity of the lubricant oil that flows in the oil gas lubricant channel may be controlled accurately to ensure the quantitative one-way lubricating. The oil gas channel connects the crankcase 1, the cam box 4, the push rod channel, the upper rocker box 6 in turns from the preceding quantitative oil intake orifice to the final quantitative airflow orifice, and very few waste oil gas that flows out from the final stage quantitative airflow orifice is introduced to the cylinder to be burned completed.

When the volume of the lubricant oil case and the power capacity of the engine is determined with a certain value, the plunge moves up-and-down with a frequency of 0.01-0.002 s to form a pulse air current. The pressure and velocity of the pulse air current is basically stable. The blow pressure and suck pressure that the pulse air current applies to the lubricant oil in the lubricant oil case is determined by controlling the diameter of the preceding stage quantitative oil intake orifice, and then the flow quantity of the lubricant oil gas that flows from the lubricant oil case 2 to the crankcase 1 is controlled. Under the above condition, the flow quantity is controlled in the range of 1.5-2 g/kw·h.

After the crankcase 1 is lubricated, and then the cam box 4 is lubricated, and the inter-stage quantitative oil orifice 41 between the crankcase 1 and the cam box 4 is designed to satisfy the relation: the diameter of the inter-stage quantitative oil orifice $D_2$ is less than or equal to $3D_1$. The pressure in the crankcase 1 is minus 0.003-0.008 Mpa during operation, and the lubricant oil that enters into the cam box 4 is controlled to satisfy the lubricating for the cam and the timing gear, and additionally, the remained lubricant oil may satisfy the lubricating for the next lubricated part, that is, the parts in the upper rocker box 6.

After the upper rocker box 6 is lubricated, the very few remaining waste oil gas is introduced into the cylinder through the final stage quantitative airflow orifice 31 that is positioned on the top of the cover of the cylinder. The size of the final stage quantitative airflow orifice 31 is designed to make sure that the lubricant oil in the machine flows out as little as possible, and meanwhile, the power capacity of the machine will not be affected. Specifically, by controlling the diameter of the final stage quantitative airflow gas orifice, the oil between the final stage quantitative airflow orifice and the cylinder flows with the velocity of 3-5 mm/s.

The quantitative one-way oil gas lubricant system provided by the present invention may be used to install various tools installed with a 4-stroke engine, such as gasoline saw, pruning shears, grass trimmer, brush cutter, electric blower, lawn mower, electric generator, water pump, high pressure washer, universal small engine and so on. However, it is should be understood that the scope of protection is not limited to the listing above.

What is claimed is:

1. A quantitative one-way oil gas lubricant system for a 4-stroke engine, wherein the 4-stroke engine including a crank, a crankcase, a lubricant case, a cam box and a cylinder, comprising:

a preceding stage quantitative oil intake orifice that is connected to the lubricant case on a wall of the crankcase; and a final stage quantitative airflow orifice disposed at a cylinder cover of the cylinder, wherein a diameter of the preceding stage quantitative oil intake orifice $D_1$ and a diameter of the final stage quantitative airflow orifice $D_3$ satisfy an equation: $D_1/D_3$=0.8-1.5, and a one-way connected oil gas lubricant channel is disposed between the preceding stage quantitative oil intake orifice and the final stage quantitative airflow orifice, wherein a relation between the diameter $D_1$ of said preceding stage quantitative oil intake orifice, a volume of the lubricant case and an engine displacement satisfies an equation: $D_1$=K(X-Y), in which, X=the volume of the lubricant case, Y=the engine displacement, the unit of $D_1$ is mm, the unit of X and Y is $cm^3$, and a value range of K is 0.011-0.02.

2. The quantitative one-way oil gas lubricant system for the 4-stroke engine of claim 1, wherein the diameter $D_1$ of said preceding stage quantitative oil intake orifice and the diameter $D_3$ of said final stage quantitative airflow orifice further satisfy an equation: $D_1/D_3$=1-1.2.

3. The quantitative one-way oil gas lubricant system for the 4-stroke engine of claim 1, wherein a distance between each side of an inner wall of the crankcase and a corresponding side of a rotating space of the crank is smaller than 2 mm.

4. The quantitative one-way oil gas lubricant system for a 4-stroke engine of claim 3, wherein a bulge part bulged to a center position of the crank along an axial direction, is disposed on two inner sides of the crankcase, which are corresponding to two side of the crank along the axial direction.

5. The quantitative one-way oil gas lubricant system for the 4-stroke engine of claim 1, wherein an inter-stage quantitative oil orifice is disposed between the crankcase and the cam box, and a diameter of the inter-stage quantitative oil orifice $D_2$ is less than or equal to $3D_1$.

6. The quantitative one-way oil gas lubricant system for the 4-stroke engine of claim 5, wherein the lubricant case has a U-shaped section perpendicular to the crankshaft, the crankcase is surrounded by the lubricant case, and the left and right sides of the crankcase are each disposed with a preceding quantitative oil intake orifice thereon, and when the 4-stroke engine is under a condition of being disposed horizontally, the two preceding stage quantitative oil intake orifices are positioned at a cross point of two center lines, one of which is a forward-backward volume center line of the lubricant case, and the other of which is a forward-backward center line of the left and right side walls of the crankcase.

7. The quantitative one-way oil gas lubricant system for the 4-stroke engine of claim 5, wherein when the 4-stroke engine is under a condition of being disposed horizontally, the preceding quantitative oil intake orifice is positioned on a cross line of a volume center surface of the lubricant oil case and a case wall of the crankcase.

8. The quantitative one-way oil gas lubricant system for the 4-stroke engine of claim 6, wherein oil-shielding ribs are disposed on an outer case wall of the crankcase, at two sides of the preceding quantitative oil intake orifice or surrounding the preceding quantitative oil intake orifice.

9. The quantitative one-way oil gas lubricant system for the 4-stroke engine of claim 5, wherein the final stage quantitative airflow orifice is connected with the cylinder through a connection pipe.

10. The quantitative one-way oil gas lubricant system for the 4-stroke engine of one of the claim 2, wherein an inter-stage quantitative oil orifice is disposed between the crankcase and the cam box, and a diameter of the inter-stage quantitative oil orifice $D_2$ is less than or equal to $3D_1$.

11. The quantitative one-way oil gas lubricant system for the4-stroke engine of one of the claim 3, wherein an inter-stage quantitative oil orifice is disposed between the crankcase and the cam box, and a diameter of the inter-stage quantitative oil orifice $D_2$ is less than or equal to $3D_1$.

12. The quantitative one-way oil gas lubricant system for the4-stroke engine of one of the claim 4, wherein an inter-stage quantitative oil orifice is disposed between the crankcase and the cam box, and a diameter of the inter-stage quantitative oil orifice $D_2$ is less than or equal to $3D_1$.

13. A quantitative one-way oil gas lubricating method of using the quantitative one-way oil gas lubricant system for the 4-stroke engine as claimed in one of claims 1, 2 and 3-9 comprising:

controlling the diameter of the preceding quantitative oil intake orifice and the diameter of the final stage quantitative airflow orifice $D_3$ to satisfy the relation: $D_1/D_3$=0.8-1.5, so that a pressure of an output end of the final stage quantitative airflow orifice is smaller than a pressure in the crankcase;

enabling a lubricant oil sucked by the crankcase from the preceding quantitative oil intake orifice to flow along the oil gas lubricant channel and to lubricate parts of the 4-stroke engine that are passed through by the oil gas lubricant channel;

introducing a minute quantity of waste oil gas that flows out from the final stage quantitative airflow orifice into a cylinder of the 4-stroke engine so as to be burned completely; and controlling the diameter of the preceding quantitative oil intake orifice $D_1$, a volume of the lubricant oil case and a power capacity of the 4-stroke engine to satisfy an equation: $D_1$=K(X-Y), wherein X=the volume of the lubricant oil case, Y=the power capacity of the engine, a blow-and-suck pressure that a pulse air current applies to the lubricant oil in the lubricant oil case is controlled so as to control a flow quality of the lubricant oil that flows from the lubricant oil case to the crankcase in a range of 1.5-2 g/kwh, wherein the unit of $D_1$ is mm, the unit of X and Y is $cm^3$, and K is a value ranges from 0.011-0.02.

14. The quantitative one-way oil gas lubricating method for the 4-stroke engine of claim 13, wherein the oil gas lubricant channel, from the preceding quantitative oil intake orifice to the final stage quantitative airflow orifice, connects the crankcase, the cam box, a push rod channel and an upper rocker box of the 4-stroke engine in turns.

15. The quantitative one-way oil gas lubricating method for a 4-stroke engine of claim 13, further comprising:

controlling the diameter of the inter-stage quantitative oil orifice $D_2$ to be less than or equal to $3D_1$, and controlling a pressure of the crankcase during operation to be in a range of minus 0.003-0.008Mpa.

* * * * *